US010779372B1

(12) United States Patent
Wu et al.

(10) Patent No.: US 10,779,372 B1
(45) Date of Patent: Sep. 15, 2020

(54) LIGHTING DEVICE WITH COMMUNICATION FUNCTION

(71) Applicant: HTC Corporation, Taoyuan (TW)

(72) Inventors: Chun-Yih Wu, Taoyuan (TW); Yen-Liang Kuo, Taoyuan (TW)

(73) Assignee: HTC CORPORATION, Taoyuan (TW)

( * ) Notice: Subject to any disclaimer, the term of this patent is extended or adjusted under 35 U.S.C. 154(b) by 0 days.

(21) Appl. No.: 16/713,128

(22) Filed: Dec. 13, 2019

(51) Int. Cl.
*H05B 45/305* (2020.01)
*F21V 23/00* (2015.01)
*F21Y 115/10* (2016.01)

(52) U.S. Cl.
CPC ..... *H05B 45/305* (2020.01); *F21V 23/004* (2013.01); *F21Y 2115/10* (2016.08)

(58) Field of Classification Search
None
See application file for complete search history.

(56) References Cited

U.S. PATENT DOCUMENTS

2012/0169235 A1* 7/2012 Dassanayake ..... F21V 7/0091 315/113
2013/0207855 A1* 8/2013 Chien ..... H01Q 9/42 343/721
2017/0146650 A1* 5/2017 Wu ..... F21V 33/0076
2017/0171944 A1* 6/2017 Kim ..... H05B 47/105

* cited by examiner

*Primary Examiner* — Jany Richardson
(74) *Attorney, Agent, or Firm* — Birch, Stewart, Kolasch & Birch, LLP

(57) ABSTRACT

A lighting device with a communication function includes a frequency selective surface, a control circuit board, and at least one light-emitting diode. The frequency selective surface includes at least one first metal piece. The first metal piece has an opening. The light-emitting diode is disposed on the control circuit board. The light-emitting diode is substantially aligned with the opening of the first metal piece.

19 Claims, 7 Drawing Sheets

LIGHTING DEVICE WITH COMMUNICATION FUNCTION

BACKGROUND OF THE INVENTION

Field of the Invention

The disclosure generally relates to a lighting device, and more particularly, to a lighting device with a communication function.

Description of the Related Art

With the advancement of technology, future street light devices will have the function of connecting to the Internet, so as to achieve the goal of building smart cities. However, the design space in a street light device is very limited, and it cannot easily accommodate Internet-relative components. Accordingly, there is a need to propose a lighting device with a communication function for solving the problems of the prior art.

BRIEF SUMMARY OF THE INVENTION

In a preferred embodiment, the invention is directed to a lighting device with a communication function. The light device includes a frequency selective surface, a control circuit board, and at least one light-emitting diode. The frequency selective surface includes at least one first metal piece. The first metal piece has an opening. The light-emitting diode is disposed on the control circuit board. The light-emitting diode is substantially aligned with the opening of the first metal piece.

In some embodiments, the frequency selective surface covers a central operation frequency equal to about 28 GHz, about 39 GHz, or about 60 GHz.

In some embodiments, the first metal piece substantially has a hollow square shape, and the opening substantially has a relatively small square shape.

In some embodiments, an edge of the first metal piece has a notch connected to the opening, such that the first metal piece substantially has a C-shape.

In some embodiments, the lighting device further includes at least one transparent lens embedded in the opening of the first metal piece.

In some embodiments, the perimeter of the first metal piece is smaller than 1 wavelength of the central operation frequency.

In some embodiments, the frequency selective surface further includes at least one second metal piece without any openings.

In some embodiments, the second metal piece substantially has a solid square shape.

In some embodiments, the perimeter of the second metal piece is smaller than 1 wavelength of the central operation frequency.

In some embodiments, the distance between the first metal piece and the second metal piece is smaller than 0.1 wavelength of the central operation frequency.

In some embodiments, the lighting device further includes an antenna element and a ground metal plane. The antenna element is disposed adjacent to the frequency selective surface. The antenna element is disposed between the frequency selective surface and the ground metal plane, or the frequency selective surface is disposed between the antenna element and the ground metal plane.

In some embodiments, the distance between the antenna element and the frequency selective surface is smaller than 0.5 wavelength of the central operation frequency.

In some embodiments, the lighting device further includes at least one switch element and at least one connection metal element. The switch element is selectively closed or opened. The first metal piece is selectively coupled through the connection metal element and the switch element to the ground metal plane.

In some embodiments, the central operation frequency of the frequency selective surface can be adjusted by controlling the switch element.

In some embodiments, the reflective direction of the frequency selective surface can be adjusted by controlling the switch element.

In some embodiments, the frequency selective surface includes a plurality of first metal pieces and a plurality of second metal pieces. The lighting device includes a plurality of light-emitting diodes.

In some embodiments, each of the first metal pieces has an opening. The light-emitting diodes are substantially aligned with the openings of the first metal pieces, respectively.

In some embodiments, the first metal pieces are substantially surrounded by the second metal pieces.

In some embodiments, the lighting device further includes a transparent substrate. The frequency selective surface is disposed on the transparent substrate.

In some embodiments, the lighting device is implemented with a street light device.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures of the invention will be described in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
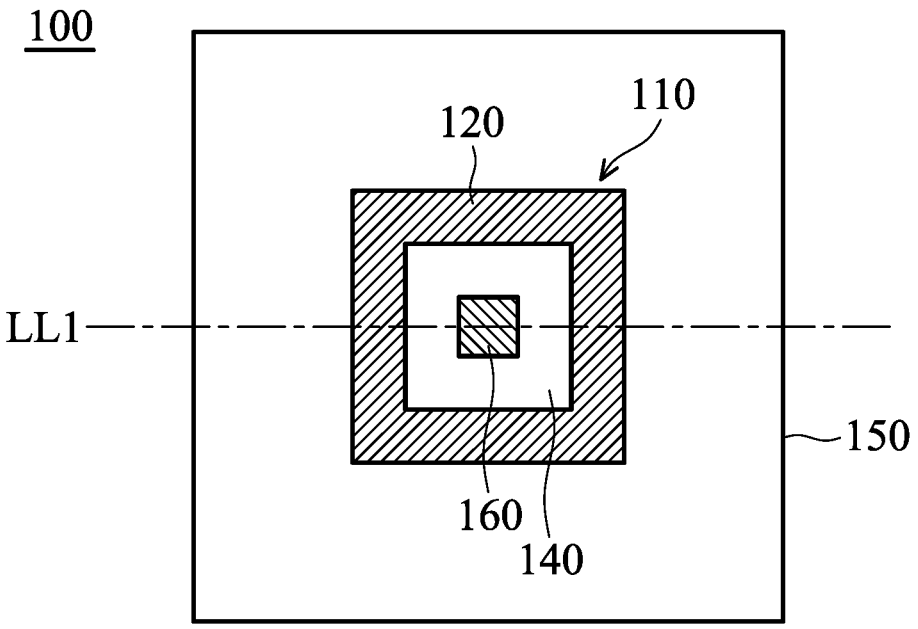
FIG. 1A is a top view of a lighting device according to an embodiment of the invention.
Figure 1B:
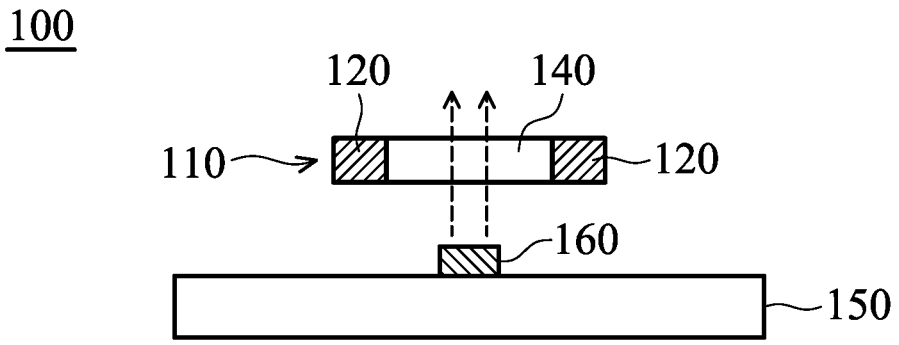
FIG. 1B is a sectional view of a lighting device according to an embodiment of the invention.

FIG. 1A is a top view of a lighting device 100 according to an embodiment of the invention. FIG. 1B is a sectional view of the lighting device 100 according to an embodiment of the invention (along a sectional line LL1 of FIG. 1A). Please refer to FIG. 1A and FIG. 1B together. The smart lighting device 100 has a communication function. For example, the lighting device 100 may be implemented with a street light device, but it is not limited thereto. As shown in FIG. 1A and FIG. 1B, the lighting device 100 includes a frequency selective surface (FSS) 110, a control circuit board 150, and at least one light-emitting diode (LED) 160. It should be understood that the lighting device 100 may further include other components, such as a light holder, a power supply module, and a housing, although they are not displayed in FIG. 1A and FIG. 1B.

The frequency selective surface 110 includes at least one first metal piece 120. The first metal piece 120 has an opening 140. For example, the first metal piece 120 may substantially have a hollow square shape, and the opening 140 may substantially have a relatively small square shape. In alternative embodiments, the shapes of the first metal piece 120 and its opening 140 are adjustable according to different requirements. The frequency selective surface 110 can cover a central operation frequency, so as to achieve the function of communication. For example, the aforementioned central operation frequency may be equal to about 28 GHz, about 39 GHz, or about 60 GHz corresponding to 5G and WiGig communication systems, but it is not limited thereto. The control circuit board 150 may be a flame retardant 4 (FR4) substrate, a printed circuit board (PCB), or a flexible circuit board (FCB). The control circuit board 150 is configured to carry a variety of circuit components and provide electric power for the light-emitting diode 160. The light-emitting diode 160 is disposed on the control circuit board 150. The light-emitting diode 160 is substantially aligned with the opening 140 of the first metal piece 120. That is, the opening 140 of the first metal piece 120 has a vertical projection on the control circuit board 150, and the whole light-emitting diode 160 is inside the vertical projection of the opening 140. With such a design, the light generated by the light-emitting diode 160 (as the dash-line arrow of FIG. 1B) can be transmitted through the opening 140 of the first metal piece 120.

The following embodiments will introduce a variety of configurations of the frequency selective surface 110. It should be understood that these figures and descriptions are merely exemplary, rather than limitations of the invention.

Figure 2:
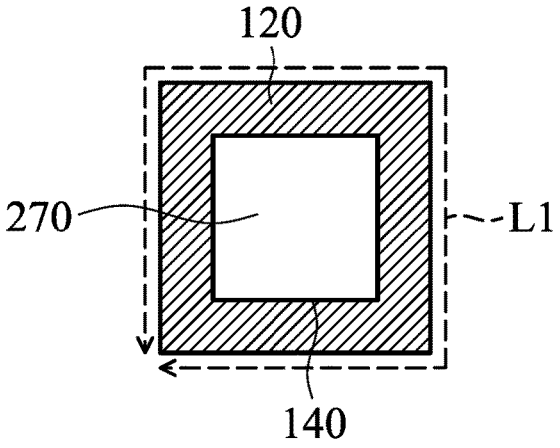
FIG. 2 is a top view of a first metal piece according to an embodiment of the invention.

FIG. 2 is a top view of the first metal piece 120 according to an embodiment of the invention. In the embodiment of FIG. 2, the lighting device 100 further includes a transparent lens 270, which is embedded in the opening 140 of the first metal piece 120. In alternative embodiments, the first metal piece 120 with the structure of the opening 140 is formed on the transparent lens 270 by using the method of plastic surface treatment metal plating (e.g., laser direct structuring). For example, the transparent lens 270 may substantially have a square shape, so as to fit the shape of the opening 140 of the first metal piece 120. The transparent lens 270 is configured to adjust the focal length or the light scattering of the light-emitting diode 160. In some embodiments, the perimeter L1 of the first metal piece 120 is smaller than 1 wavelength (1λ) of the central operation frequency of the frequency selective surface 110, such as 0.5 wavelength (λ/2) or 0.25 wavelength (λ/4).

Figure 3A:
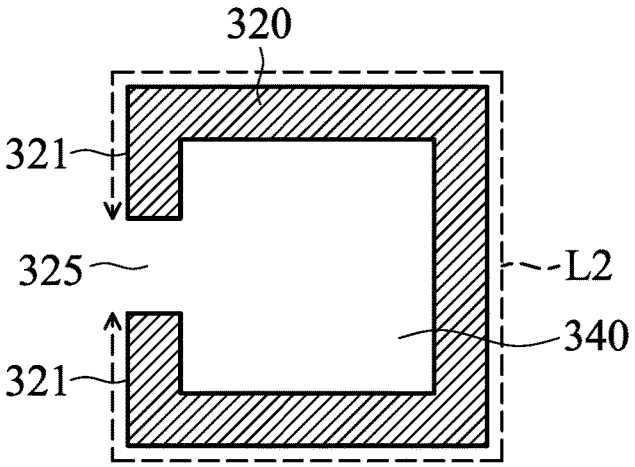
FIG. 3A is a top view of a first metal piece according to another embodiment of the invention.

FIG. 3A is a top view of a first metal piece 320 according to another embodiment of the invention. The first metal piece 320 may be applied to the frequency selective surface 110 of FIG. 1. In the embodiment of FIG. 3A, an edge 321 of the first metal piece 320 has a notch 325. The notch 325 is connected to the opening 340 of the first metal piece 320, such that the first metal piece 320 substantially has a C-shape or a U-shape. In some embodiments, the perimeter L2 of the first metal piece 320 is smaller than 1 wavelength (1λ) of the central operation frequency of the frequency selective surface 110, such as 0.5 wavelength (λ/2) or 0.25 wavelength (λ/4).

Figure 3B:
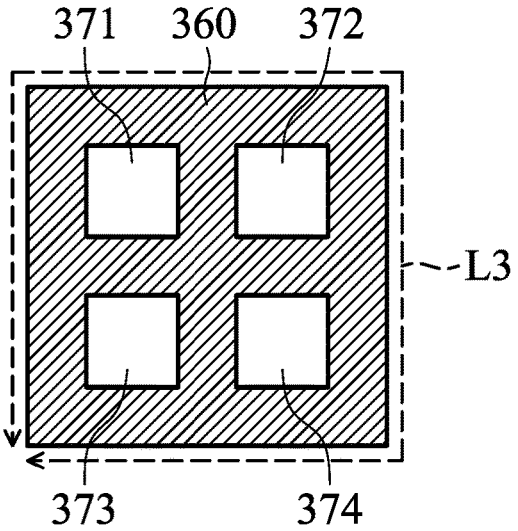
FIG. 3B is a top view of a first metal piece according to another embodiment of the invention.

FIG. 3B is a top view of a first metal piece 360 according to another embodiment of the invention. The first metal piece 360 may be applied to the frequency selective surface 110 of FIG. 1. In the embodiment of FIG. 3B, the first metal piece 360 has a plurality of openings 371, 372, 373 and 374. The number of openings 371, 372, 373 and 374 is not limited. For example, each of the openings 371, 372, 373 and 374 may substantially have a small square shape. In alternative embodiments, the shapes of the first metal piece 360 and its openings 371, 372, 373 and 374 are adjustable according to different requirements. The light-emitting diode 160 may be substantially aligned with any of the openings 371, 372, 373 and 374. Furthermore, if the lighting device 100 includes a plurality of light-emitting diodes 160, these light-emitting diodes 160 may be substantially aligned with the openings 371, 372, 373 and 374 of the first metal piece 360, respectively. In some embodiments, the perimeter L3 of the first metal piece 360 is smaller than 1 wavelength (1λ) of the central operation frequency of the frequency selective surface 110, such as 0.5 wavelength (λ/2) or 0.25 wavelength (λ/4).

Figure 4A:
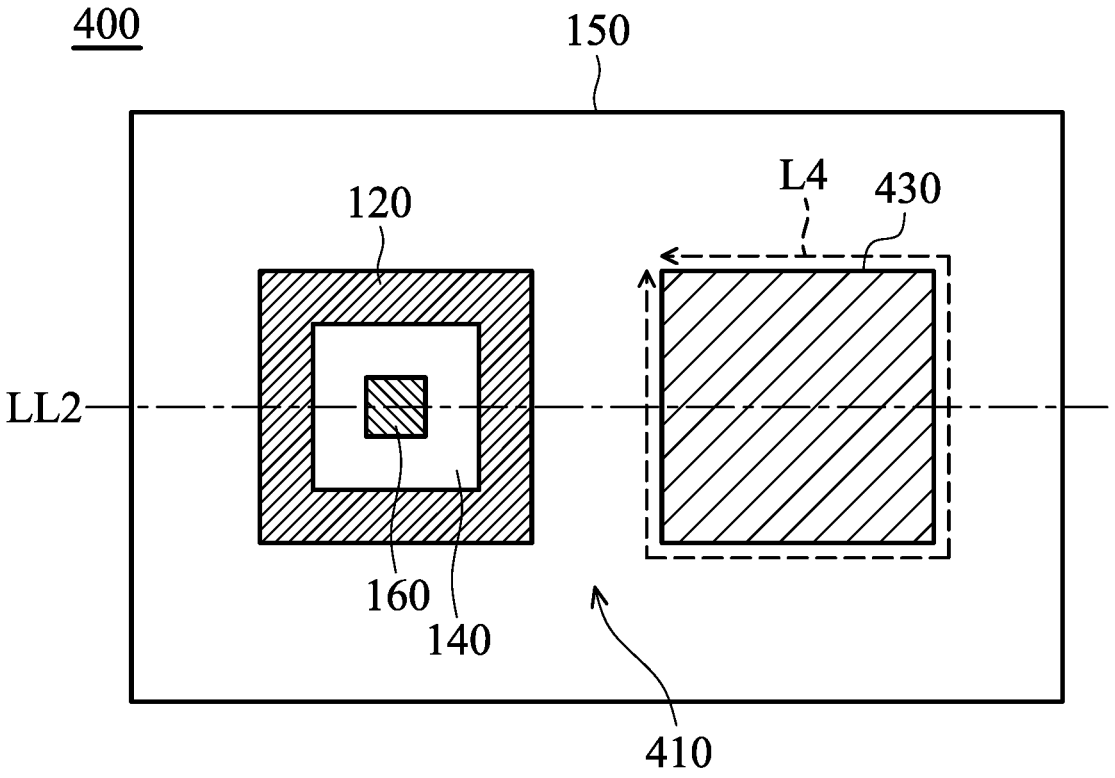
FIG. 4A is a top view of a lighting device according to another embodiment of the invention.
Figure 4B:
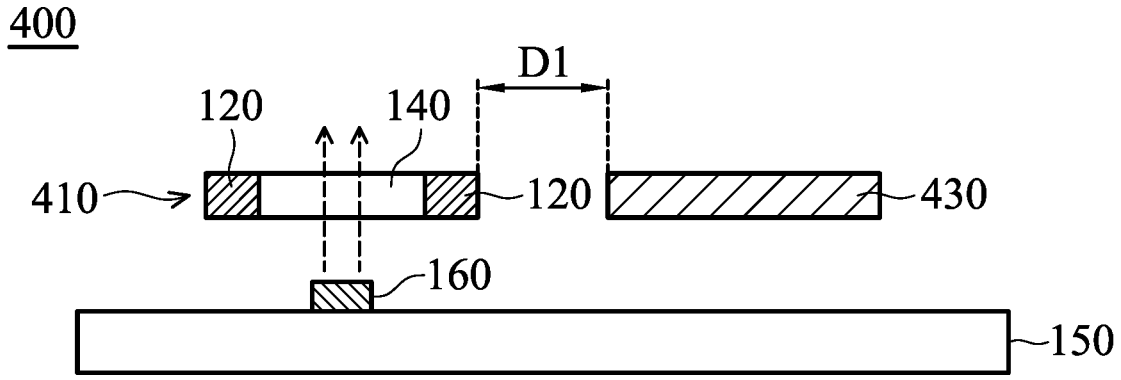
FIG. 4B is a sectional view of a lighting device according to another embodiment of the invention.

FIG. 4A is a top view of a lighting device 400 according to another embodiment of the invention. FIG. 4B is a sectional view of the lighting device 400 according to another embodiment of the invention (along a sectional line LL2 of FIG. 4A). Please refer to FIG. 4A and FIG. 4B together. FIG. 4A and FIG. 4B are similar to FIG. 1A and FIG. 1B. In the embodiment of FIG. 4A and FIG. 4B, a frequency selective surface 410 of the lighting device 400 includes at least one first metal piece 120 and at least one second metal piece 430. The second metal piece 430 does not have any openings. For example, the second metal piece 430 may substantially have a solid square shape, whose size may be the same as the size of the first metal piece 120. In alternative embodiments, the shape of the second metal piece 430 is adjustable according to different requirements. Since the effective resonant length of the second metal piece 430 is different from that of the first metal piece 120, the incorporation of the second metal piece 430 can increase the operation bandwidth of the frequency selective surface 410. In some embodiments, the perimeter L4 of the second metal piece 430 is smaller than 1 wavelength (1λ) of the central operation frequency of the frequency selective surface 410, such as 0.5 wavelength (λ/2) or 0.25 wavelength (λ/4), and the distance D1 between the first metal piece 120 and the second metal piece 430 is smaller than 0.1 wavelength (λ/10) of the central operation frequency of the frequency selective surface 410. It should be noted that the above ranges of the perimeters and distances are calculated and obtained according to many experiment results, and they help to optimize the selection performance of each frequency selective surface.

Figure 5A:
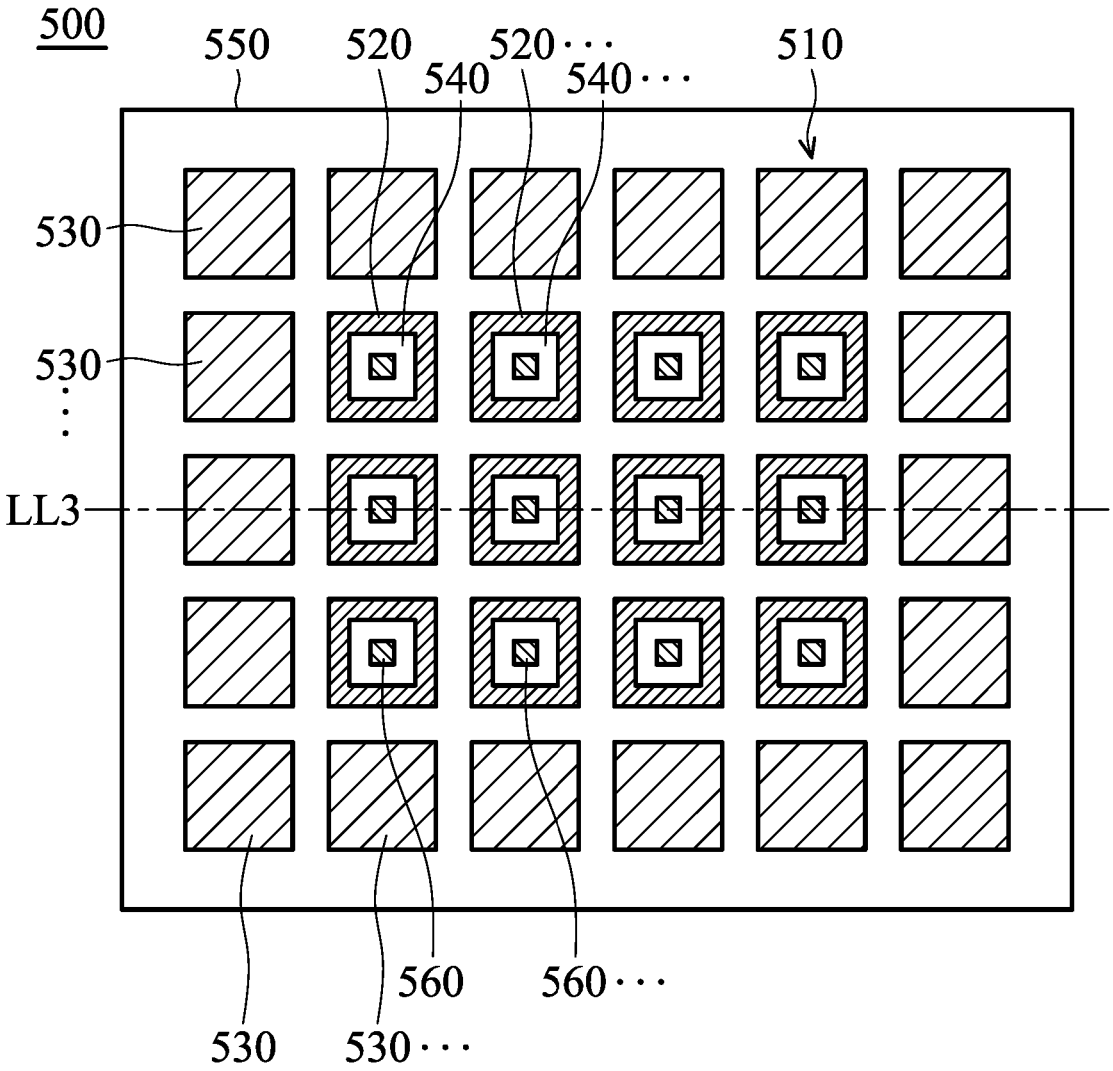
FIG. 5A is a top view of a lighting device according to an embodiment of the invention.
Figure 5B:
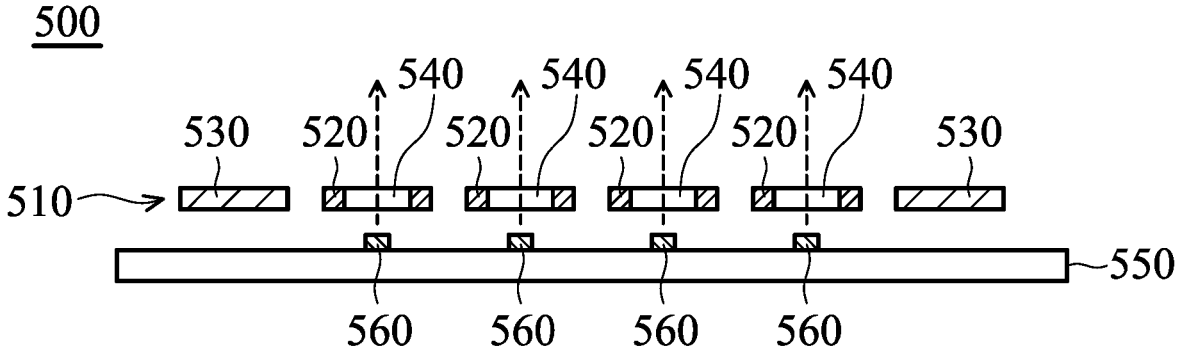
FIG. 5B is a sectional view of a lighting device according to an embodiment of the invention.

FIG. 5A is a top view of a lighting device 500 according to an embodiment of the invention. FIG. 5B is a sectional view of the lighting device 500 according to an embodiment of the invention (along a sectional line LL3 of FIG. 5A). Please refer to FIG. 5A and FIG. 5B together. FIG. 5A and FIG. 5B are similar to FIG. 1A and FIG. 1B. In the embodiment of FIG. 5A and FIG. 5B, the lighting device 500 includes a frequency selective surface 510, a control circuit board 550, and a plurality of light-emitting diodes 560. The light-emitting diodes 560 are all disposed on the control circuit board 550. The frequency selective surface 510 has a periodic structure and includes a plurality of first metal pieces 520 and a plurality of second metal pieces 530. The number of first metal pieces 520 may be greater than or equal to the number of light-emitting diodes 560. Specifically, each of the first metal pieces 520 has an opening 540, and the light-emitting diodes 560 are substantially aligned with the openings 540 of the first metal pieces 520, respectively. Thus, the light generated by the light-emitting diodes 560 (as the dash-line arrow of FIG. 5B) can be transmitted through the openings 540 of the first metal pieces 520. In some embodiments, the combination of the second metal pieces 530 substantially has a hollow rectangular shape, and the first metal pieces 520 are substantially surrounded by the second metal pieces 530. According to practical measurements, such an arrangement of the second metal pieces 530 surrounding the first metal pieces 520 can further increase the operation bandwidth of the frequency selective surface 510.

Figure 6A:
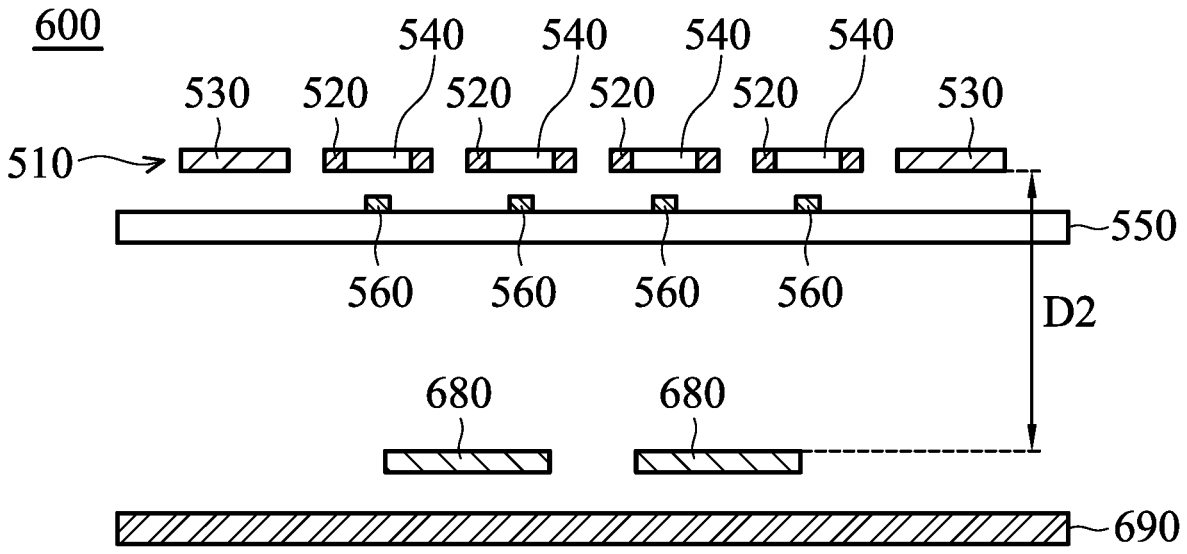
FIG. 6A is a sectional view of a lighting device according to another embodiment of the invention.

FIG. 6A is a sectional view of a lighting device 600 according to another embodiment of the invention. FIG. 6A is similar to FIG. 5B. In the embodiment of FIG. 6A, the lighting device 600 includes a frequency selective surface 510, a control circuit board 550, a plurality of light-emitting diodes 560, an antenna element 680, and a ground metal plane 690. The shapes and types of the antenna element 680 are not limited in the invention. For example, the antenna element 680 may be a monopole antenna, a dipole antenna, a loop antenna, a patch antenna, or a chip antenna. The antenna element 680 is adjacent to the frequency selective surface 510. It should be noted that the term "adjacent" or "close" over the disclosure means that the distance (spacing) between two corresponding elements is smaller than a predetermined distance (e.g., 10 mm or shorter), but does not mean that the two corresponding elements directly touch each other (i.e., the aforementioned distance/spacing therebetween is reduced to 0). The ground metal plane 690 can provide a ground voltage. The antenna element 680 is disposed between the frequency selective surface 510 and the ground metal plane 690. The antenna element 680 is configured to generate electromagnetic waves. The electromagnetic waves may be partially transmitted through the frequency selective surface 510, and partially reflected by the frequency selective surface 510 and the ground metal plane 690. Within the central operation frequency of the frequency selective surface 510, the electromagnetic waves of the antenna element 680 can generate constructive interference due to the frequency selective surface 510, thereby increasing the total gain of the antenna element 680. In order to enhance the constructive interference, the distance D2 between the antenna element 680 and the frequency selective surface 510 may be smaller than 0.5 wavelength (λ/2) of the central operation frequency of the frequency selective surface 510, such as 0.25 wavelength (λ/4).

Figure 6B:
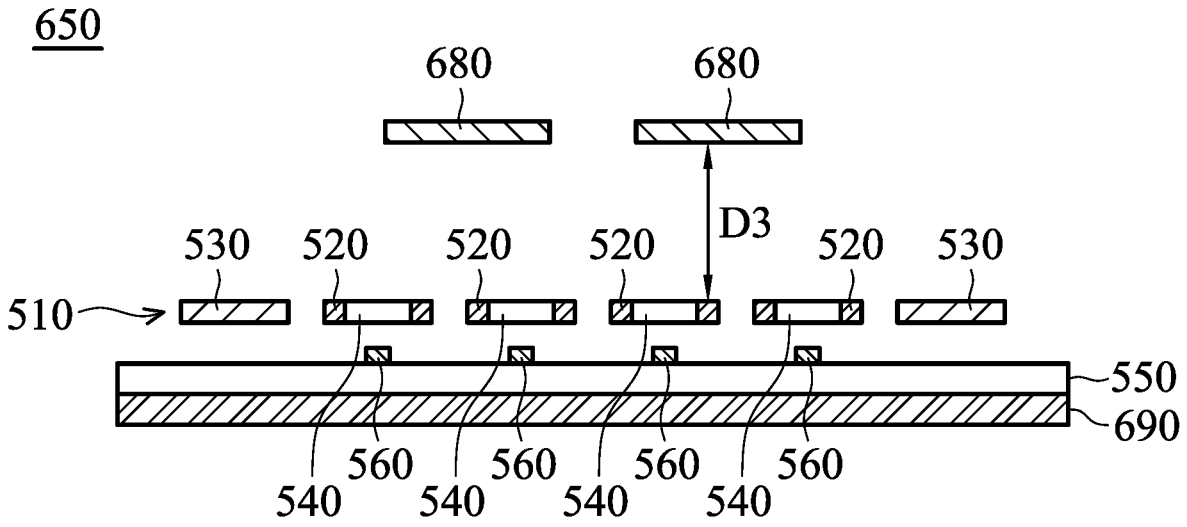
FIG. 6B is a sectional view of a lighting device according to another embodiment of the invention.

FIG. 6B is a sectional view of a lighting device 650 according to another embodiment of the invention. FIG. 6B is similar to FIG. 6A. In the lighting device 650 of the embodiment of FIG. 6B, the frequency selective surface 510 is changed and disposed between the antenna element 680 and the ground metal plane 690, such that the electromagnetic waves of the antenna element 680 can be reflected by the frequency selective surface 510 and the ground metal plane 690. Similarly, within the central operation frequency of the frequency selective surface 510, the electromagnetic waves of the antenna element 680 can generate constructive interference due to the frequency selective surface 510, thereby increasing the total gain of the antenna element 680. In order to enhance the constructive interference, the distance D3 between the antenna element 680 and the frequency selective surface 510 may be smaller than 0.5 wavelength (λ/2) of the central operation frequency of the frequency selective surface 510, such as 0.25 wavelength (λ/4).

Figure 7:
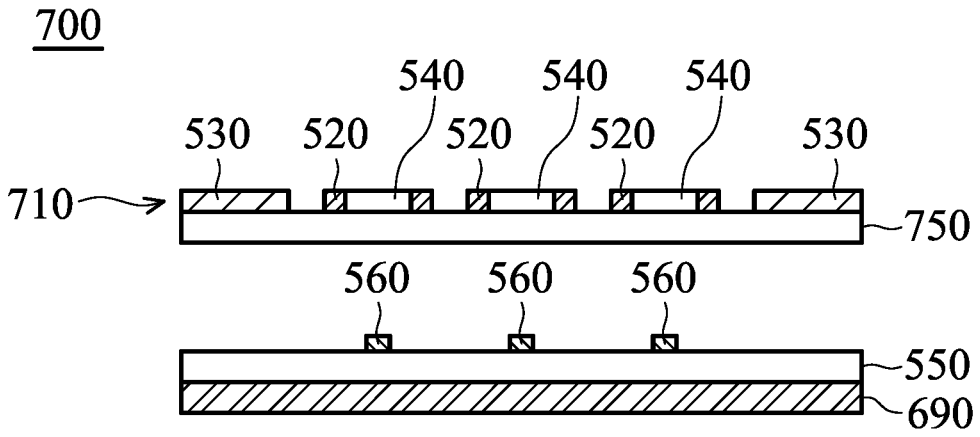
FIG. 7 is a sectional view of a lighting device according to an embodiment of the invention.

FIG. 7 is a sectional view of a lighting device 700 according to an embodiment of the invention. In the embodiment of FIG. 7, the lighting device 700 further includes a transparent substrate 750. A plurality of first metal pieces 520 and a plurality of second metal pieces 530 of a frequency selective surface 710 are all disposed on the transparent substrate 750. For example, the transparent substrate 750 may be made of a polycarbonate material. It should be noted that the transparent substrate 750 neither blocks the light generated by a plurality of light-emitting diodes 560, nor interferes with the transmission of any electromagnetic waves. Thus, the transparent substrate 750 is used as a good carrier of the frequency selective surface 710.

Figure 8:
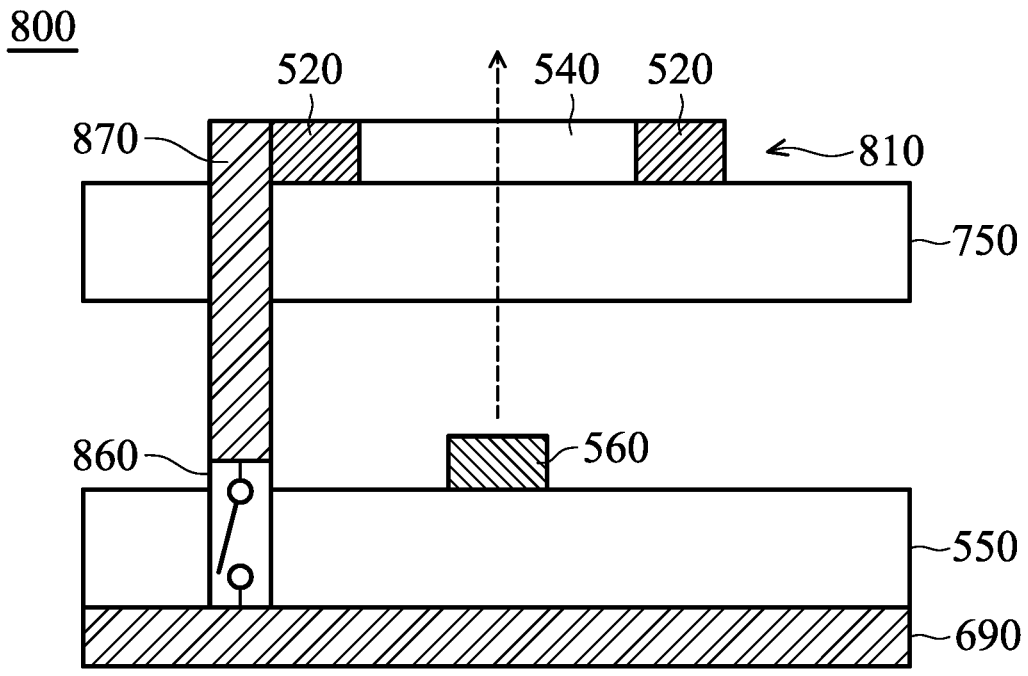
FIG. 8 is a sectional view of a lighting device according to another embodiment of the invention.

FIG. 8 is a sectional view of a lighting device 800 according to another embodiment of the invention. In the embodiment of FIG. 8, the lighting device 800 includes a frequency selective surface 810, a control circuit board 550, at least one light-emitting diode 560, a transparent substrate 750, a ground metal plane 690, a switch element 860, and a connection metal element 870. The frequency selective surface 810 includes at least one first metal piece 520. The first metal piece 520 has an opening 540. The first metal piece 520 is disposed on the transparent substrate 750. The light-emitting diode 560 is disposed on the control circuit board 550. The control circuit board 550 is disposed on the ground metal plane 690. The light generated by the light-emitting diode 560 (as the dash-line arrow of FIG. 8) can be transmitted through the transparent substrate 750 and the opening 540 of the first metal piece 520. The connection metal element 870 may be a via element, a pogo pin, or a metal spring, but it is not limited thereto. The connection metal element 870 and the switch element 860 can penetrate the transparent substrate 750 and the control circuit board 550. The connection metal element 870 is coupled between the first metal piece 520 and the switch element 860. The switch element 860 is coupled to the ground metal plane 690. Specifically, the switch element 860 is selectively closed or opened according to a control signal, such that the first metal piece 520 is selectively coupled through the connection metal element 870 and the switch element 860 to the ground metal plane 690. The aforementioned control signal may be generated by a processor according to a user's input. In some embodiments, a central operation frequency of the frequency selective surface 810 can be adjusted by controlling the switch element 860. This not only increases the operation bandwidth of the frequency selective surface 810, but also makes the frequency selective surface 810 have different electromagnetic reflective characteristics due to the change in the operation frequency. It should be noted that the design of the switch element 860 and the connection metal element 870 of FIG. 8 can be applied to any first metal piece or any second metal piece of the frequency selective surface in each of the above embodiments.

Figure 9:
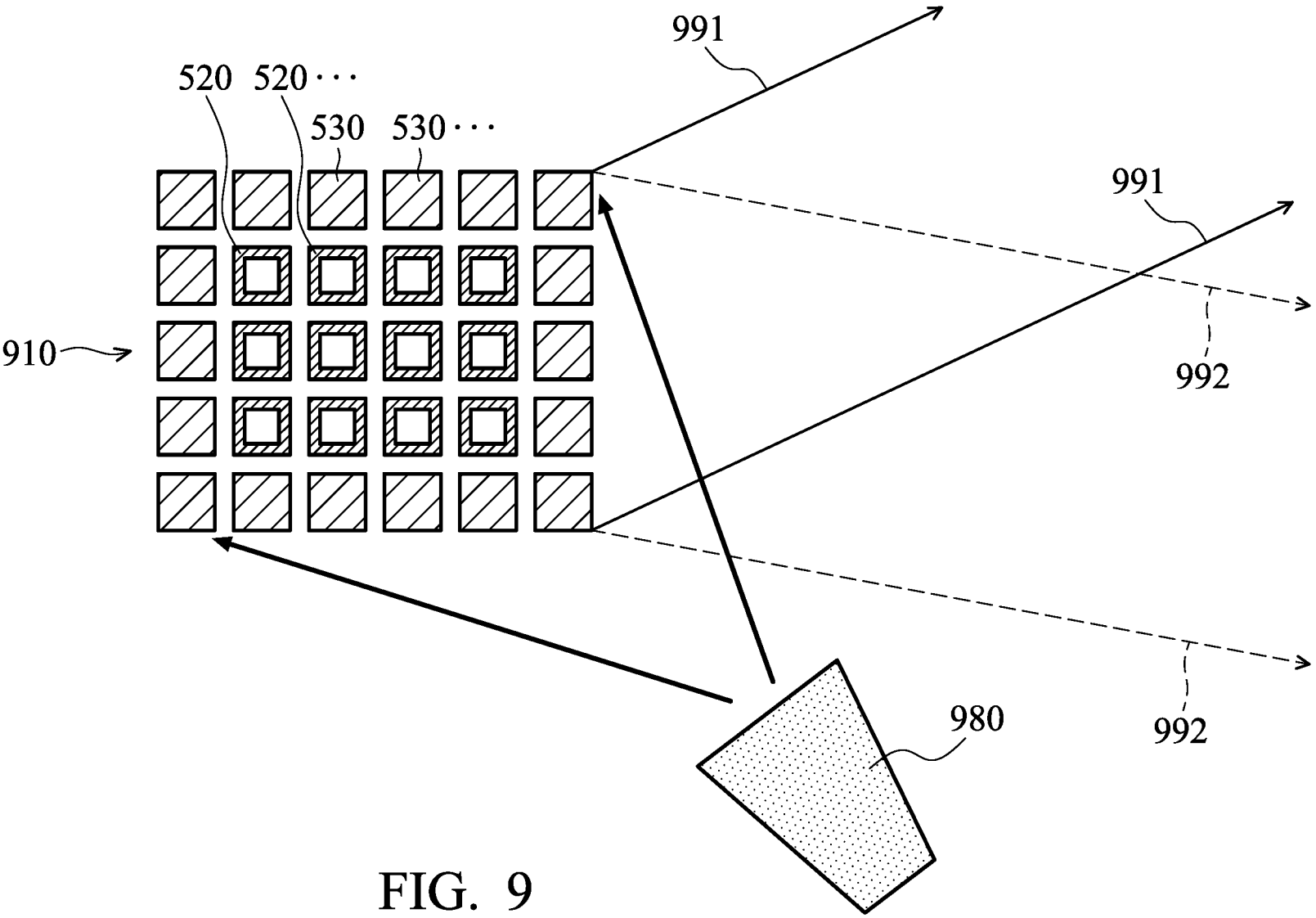
FIG. 9 is a diagram of a frequency selective surface according to an embodiment of the invention.

FIG. 9 is a diagram of a frequency selective surface 910 according to an embodiment of the invention. The frequency selective surface 910 includes the switch element 860 and the connection metal element 870 of FIG. 8 (not shown). A signal transmitter, such as an antenna element 980 for implementation, transmits electromagnetic waves toward the frequency selective surface 910. If the switch element 860 is closed, one or more first metal pieces 520 of the frequency selective surface 910 will be grounded, such that the electromagnetic waves of the antenna element 980 can be reflected toward a first direction 991 by the frequency selective surface 910. Conversely, if the switch element 860 is opened, one or more first metal pieces 520 of the frequency selective surface 910 will be floating, such that the electromagnetic waves of the antenna element 980 can be reflected toward a second direction 992 by the frequency selective surface 910. The second direction 992 is different from the first direction 991. That is, a reflective direction of the frequency selective surface 910 can be adjusted by controlling the switch element 680.

The invention proposed a novel lighting device for integrating a frequency selective surface with a light-emitting diode, so as to provide both the functions of communication and lighting. Generally, the invention has at least the advantages of small size, high antenna gain, and beautiful device appearance, and it is suitable for application in a variety of communication or lighting devices.

Note that the above element sizes, element shapes, and frequency ranges are not limitations of the invention. A designer can fine-tune these settings or values according to different requirements. It should be understood that the lighting device of the invention is not limited to the configurations of FIGS. 1-9. The invention may include any one or more features of any one or more embodiments of FIGS. 1-9. In other words, not all of the features displayed in the figures should be implemented in the structure of lighting device of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A lighting device, comprising:

a frequency selective surface, comprising at least a first metal piece, wherein the first metal piece has an opening;

a control circuit board; and at least a light-emitting diode, disposed on the control circuit board, wherein the light-emitting diode is substantially aligned with the opening of the first metal piece;

wherein the frequency selective surface further comprises at least a second metal piece without any openings.

2. The lighting device as claimed in claim 1, wherein the frequency selective surface covers a central operation frequency equal to about 28 GHz, about 39 GHz, or about 60 GHz.

3. The lighting device as claimed in claim 2, wherein a perimeter of the first metal piece is smaller than 1 wavelength of the central operation frequency.

4. The lighting device as claimed in claim 2, wherein the second metal piece substantially has a solid square shape.

5. The lighting device as claimed in claim 2, wherein a perimeter of the second metal piece is smaller than 1 wavelength of the central operation frequency.

6. The lighting device as claimed in claim 2, wherein a distance between the first metal piece and the second metal piece is smaller than 0.1 wavelength of the central operation frequency.

7. The lighting device as claimed in claim 2, further comprising:

an antenna element, disposed adjacent to the frequency selective surface; and a ground metal plane, wherein the antenna element is disposed between the frequency selective surface and the ground metal plane, or the frequency selective surface is disposed between the antenna element and the ground metal plane.

8. The lighting device as claimed in claim 7, wherein a distance between the antenna element and the frequency selective surface is smaller than 0.5 wavelength of the central operation frequency.

9. The lighting device as claimed in claim 7, further comprising:

at least a switch element, selectively closed or opened; and at least a connection metal element, wherein the first metal piece is selectively coupled through the connection metal element and the switch element to the ground metal plane.

10. The lighting device as claimed in claim 9, wherein the central operation frequency of the frequency selective surface is adjusted by controlling the switch element.

11. The lighting device as claimed in claim 9, wherein a reflective direction of the frequency selective surface is adjusted by controlling the switch element.

12. The lighting device as claimed in claim 1, wherein the first metal piece substantially has a hollow square shape, and the opening substantially has a relatively small square shape.

13. The lighting device as claimed in claim 1, wherein an edge of the first metal piece has a notch connected to the opening, such that the first metal piece substantially has a C-shape.

14. The lighting device as claimed in claim 1, further comprising:

at least a transparent lens, embedded in the opening of the first metal piece.

15. The lighting device as claimed in claim 1, wherein the frequency selective surface comprises a plurality of first metal pieces and a plurality of second metal pieces, and the lighting device comprises a plurality of light-emitting diodes.

16. The lighting device as claimed in claim 15, wherein each of the first metal pieces has an opening, and the light-emitting diodes are substantially aligned with the openings of the first metal pieces, respectively.

17. The lighting device as claimed in claim 15, wherein the first metal pieces are substantially surrounded by the second metal pieces.

18. The lighting device as claimed in claim 1, further comprising:

a transparent substrate, wherein the frequency selective surface is disposed on the transparent substrate.

19. The lighting device as claimed in claim 1, wherein the lighting device is implemented with a street light device.

* * * * *